US008212465B2

(12) United States Patent
Jeong et al.

(10) Patent No.: US 8,212,465 B2
(45) Date of Patent: Jul. 3, 2012

(54) FIELD EMISSION DEVICE

(75) Inventors: Jin Woo Jeong, Daejeon (KR); Yoon Ho Song, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 113 days.

(21) Appl. No.: 12/576,397

(22) Filed: Oct. 9, 2009

(65) Prior Publication Data

US 2010/0133980 A1 Jun. 3, 2010

(30) Foreign Application Priority Data

Dec. 2, 2008 (KR) ..... 10-2008-0121137

(51) Int. Cl.
*H01J 1/62* (2006.01)

(52) U.S. Cl. ..... 313/497; 313/309; 313/336; 313/351

(58) Field of Classification Search ..... None
See application file for complete search history.

(56) References Cited

U.S. PATENT DOCUMENTS 6,008,569 A * 12/1999 Yamanobe ..... 313/310
6,441,559 B1 8/2002 Yamamoto et al.
2003/0001490 A1* 1/2003 Yamamoto et al. ..... 313/495
2004/0145299 A1* 7/2004 Wang et al. ..... 313/497
2005/0168133 A1* 8/2005 Toyota et al. ..... 313/497
2005/0275331 A1* 12/2005 Takai et al. ..... 313/311
2007/0257592 A1* 11/2007 Li et al. ..... 313/311
2009/0085459 A1* 4/2009 Hanson ..... 313/495
2010/0072879 A1* 3/2010 Fennimore et al. ..... 313/496

FOREIGN PATENT DOCUMENTS

JP 11-213910 8/1999
KR 10-2004-0044101 A 5/2004
KR 2005-0051308 A 6/2005
KR 10-2006-0015901 A 2/2006

* cited by examiner

*Primary Examiner* — Ashok Patel
(74) *Attorney, Agent, or Firm* — Rabin & Berdo, P.C.

(57) ABSTRACT

Provided is a field emission device. The field emission device includes an insulated cathode substrate facing an anode substrate, a plurality of cathodes arranged on the cathode substrate and separated from each other, and an emitter formed on each of the cathodes. In order to prevent accumulation of charges on an exposed area of the cathode substrate between the cathodes due to electrons discharged from the emitter, the distance between the cathodes is equal to or smaller than a first threshold value, and the distance from the emitter to the end of the cathode is equal to or greater than a second threshold value. Accordingly, in the field emission device in which a plurality of cathodes are separated from each other on the same plane, it is possible to prevent abnormal field emission and arc generation due to accumulated charges between the cathodes, thereby performing stable operation.

6 Claims, 10 Drawing Sheets

0S

8S

38S

112S

FIELD EMISSION DEVICE

CROSS-REFERENCE TO RELATED APPLICATION

This application claims the priority and benefit of Korean Patent Application No. 10-2008-0121137, filed Dec. 2, 2008, the disclosure of which is incorporated herein by reference in its entirety.

BACKGROUND

1. Field of the Invention

The present invention relates to a field emission device. More specifically, the present invention relates to a field emission device having a cathode structure for stable field emission.

2. Discussion of Related Art

In a typical field emission device, cathodes are separated from each other at adequate intervals for electrical disconnection on a plane, and field emitters, such as carbon nanotubes, are formed on the separated electrodes.

FIG. 1 is a cross-sectional view of a conventional field emission device having a plurality of cathodes, FIG. 2 shows how charges accumulate on an insulator of the field emission device of FIG. 1, and FIG. 3 shows abnormal field emission due to accumulated charges.

As shown in FIG. 1, a plurality of cathodes 110 are arranged separated from each other on a cathode substrate 100 facing an anode substrate 150 and an anode 160. A field emitter 120 is formed on each cathode 110. In a space 121 between the separated cathodes 110, charges may accumulate on the cathode substrate 100, which is like an uncovered area of a glass substrate and is an insulator when field emission is performed at a high voltage as shown in FIG. 2. In other words, electrons 171 are normally emitted and accelerated by an electric field formed by the voltage supplied to the anode 160. However, some electrons 172 may abnormally scatter, and the glass substrate 100 hit by the electrons 172 may generate secondary electrons 173 and positive ions 174.

If the positive ions 174, which are located in the space between the anode substrate 150 and the cathode substrate 100, accumulate in the space 121 between the cathodes 110, the amount of charges gradually increases because the insulated cathode substrate 100 is unable to transmit the accumulated charges, which results in abnormal operation.

As shown in FIG. 3, in addition to a normal electric field E formed by the anode 160 inducing electrons from the field emitter 120, an electric field $E_{charge}$ is formed by positive charges 175 between the insulated cathodes 110. This causes abnormal field emission.

Since the amount of the accumulated charges 175 varies over time and the surface condition of an insulated area where there is no electrode, it is difficult to control the amount of accumulated charges 175. Moreover, if too many charges accumulate over time for the insulated cathode substrate 100 to accommodate, the accumulated charges will suddenly discharge to the adjacent cathode 110. Such an arc discharge phenomenon is a very dangerous factor affecting the stability of the field emission device.

If the density of the field emitters on the cathodes is increased without considering abnormal operation of the field emission device due to charge accumulation, a variety of problems may occur. The present invention provides a method for overcoming abnormal operation due to the above causes.

SUMMARY OF THE INVENTION

The present invention provides a cathode structure that enables stable field emission by preventing accumulation of charges on an insulator during field emission.

According to an exemplary embodiment of the present invention, a field emission device includes: an insulated cathode substrate facing an anode substrate; a plurality of cathodes arranged on the cathode substrate and separated from each other; and an emitter formed on each of the cathodes. Here, a distance between the cathodes may be equal to or smaller than a first threshold value.

A distance from the emitter to a corresponding end of the cathode may be equal to or greater than a second threshold value.

The cathode substrate may be a soda-lime glass substrate.

If the cathode is made of chrome by vacuum deposition, the first threshold value may be about 50 μm and the second threshold value may be about 150 μm.

The field emission device may further include a gate electrode formed between the cathode and an anode to enable the emitter to discharge electrons.

According to another exemplary embodiment of the present invention, a field emission device includes: an insulated cathode substrate facing an anode substrate; a plurality of cathodes arranged on the cathode substrate and separated from each other; an emitter formed on each of the cathodes; and a charge accumulation prevention unit configured to prevent accumulation of charges on an exposed area of the cathode substrate between the cathodes.

The charge accumulation prevention unit may be a resistor having a predetermined resistance, formed between the plurality of cathodes.

The resistor may be formed to cover an entire area of the cathode substrate between the cathode and the cathode substrate.

The resistor may be formed to cover an exposed area of the cathode substrate.

The charge accumulation prevention unit can have a stepped area formed between the cathode and the cathode substrate and having a value equal to or greater than a threshold value.

The stepped area may be made by forming a groove in an exposed area of the cathode substrate between the cathodes.

The stepped area may be made by forming the cathodes to have a thickness that is equal to or greater than the threshold value.

The field emission device may further include a gate electrode formed between the cathode and an anode to enable the emitter to discharge electrons.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which.

DETAILED DESCRIPTION OF EXEMPLARY EMBODIMENTS

Figure 1:
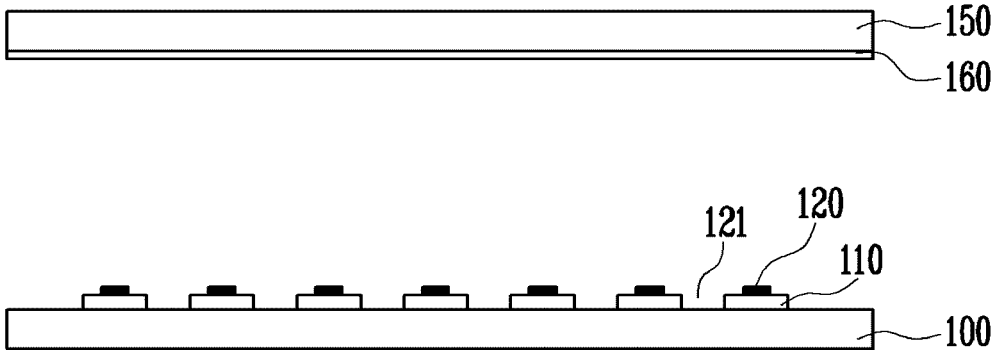
FIG. 1 (PRIOR ART)
FIG. 1 is a cross-sectional view of a conventional field emission device having a plurality of cathodes.
Figure 2:
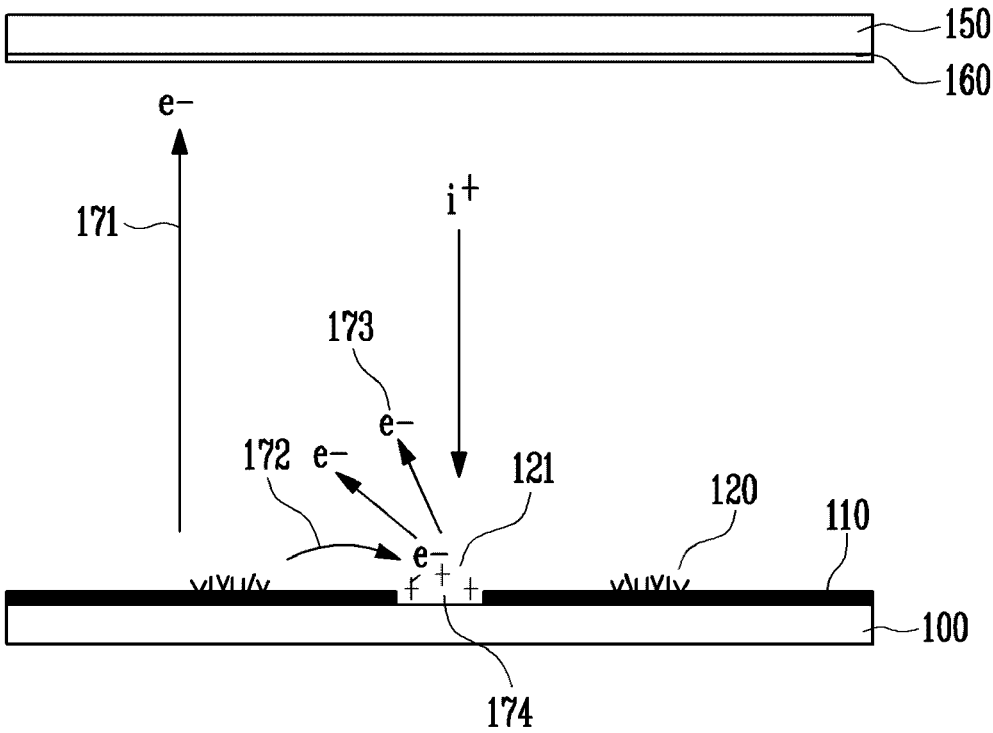
FIG. 2 (PRIOR ART)
FIG. 2 shows how charges accumulate on an insulator of the field emission device of FIG. 1.
Figure 3:
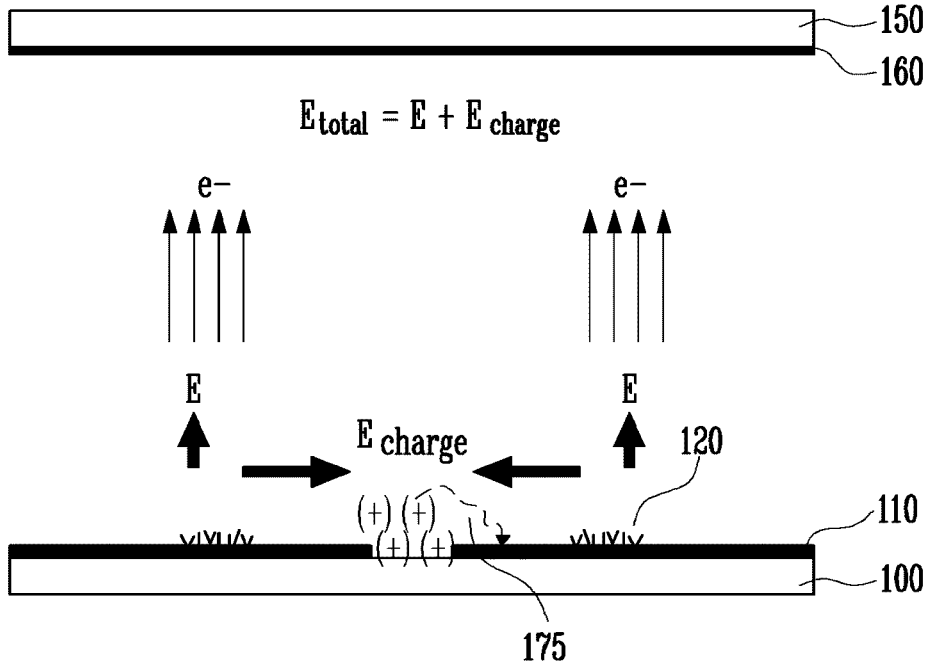
FIG. 3 (PRIOR ART)
FIG. 3 shows abnormal field emission due to accumulated charges.

Exemplary embodiments of the present invention will be described in detail with reference to accompanying drawings. This invention may, however, be embodied in different forms and should not be construed as limited to the exemplary embodiments set forth herein. Throughout the drawings, elements are denoted by the same reference numerals. Throughout the detailed description, technology that is well known to those of skill in the art will not be described when it is deemed that such description would detract from the clarity and concision of the disclosure of the invention.

Throughout the description of the present invention, when one element is described as "comprising" another element, it shall be construed as comprising another element and also as possibly further comprising yet another element unless otherwise defined explicitly.

A field emission device according to an exemplary embodiment of the present invention will now be described with reference to FIGS. 4 and 5.

Figure 4:
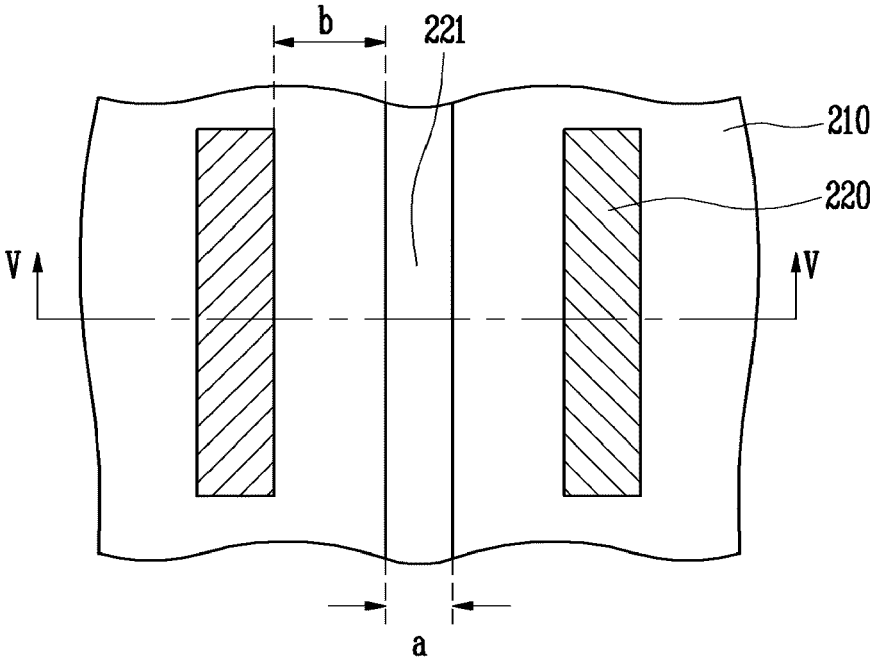
FIG. 4 shows the configuration of a field emission device in accordance with an exemplary embodiment of the present invention.
Figure 5:
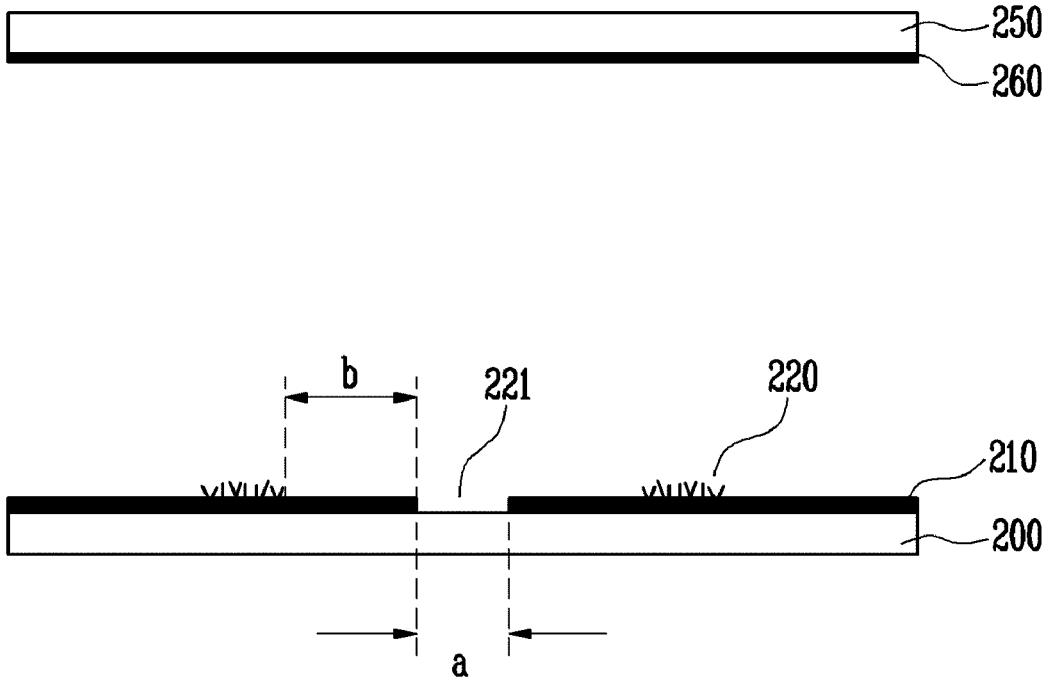
FIG. 5 is a cross-sectional view of the field emission device of FIG. 4, taken along line V-V.

FIG. 4 shows the configuration of a field emission device in accordance with an exemplary embodiment of the present invention, and FIG. 5 is a cross-sectional view of the field emission device of FIG. 4, taken along line V-V.

As shown in FIGS. 4 and 5, in the field emission device according to an exemplary embodiment of the present invention, a plurality of cathodes 210 may be arranged to be separated from each other on a cathode substrate 200 facing an anode substrate 250 and an anode 260.

Here, as a distance "a" between the cathodes 210 increases, an exposed area of the insulated cathode substrate 200 widens and a chance of abnormal accumulation of charges increases. Accordingly, the separation distance "a" may be equal to or smaller than a certain distance La.

A field emitter 220 may be formed on each cathode 210. If a distance "b" between one end of the field emitter 220 and a corresponding end of the cathode 210 is small, abnormal field emission may result from an electric field formed by the charges accumulated on the insulated cathode substrate 200, or the likelihood of charges accumulating on the insulated cathode substrate 200 may increase due to electrons discharged from the field emitter 220. Accordingly, the distance "b" may be equal to or greater than a certain distance Lb.

Here, the certain distances La and Lb depend on the type and surface condition of the substrate and electrode materials. Examples in which the certain distances La and Lb are experimentally determined under given conditions will be described below.

A minimum value Lmin of the separation distance "a" may be the smallest value that can be achieved by semiconductor processing technology, and a maximum value Lmax of the distance "b" may be the largest value that does not lower the performance of the field emission device. That is, the distances "a" and "b" satisfy the following formulae.

[Formulae]

$$L_{min} < a < L_a$$

$$L_b < b < L_{max}$$

Field emission results according to changes in the distances "a" and "b" will be described with reference to FIG. 6, FIGS. 7A through 7D, and FIGS. 8A through 8D.

Figure 6:
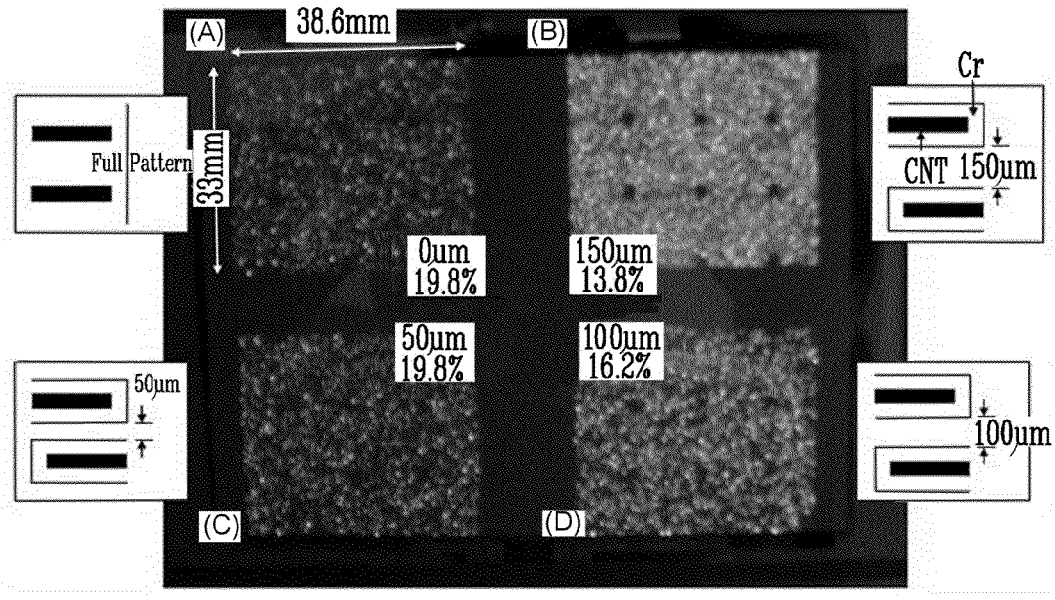
FIG. 6 shows field emission results according to distance "a" of FIG. 5.
Figure 7A:
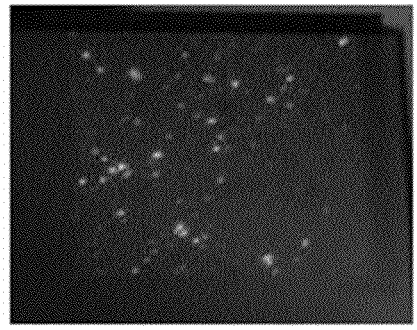
FIGS. 7A through 7D show abnormal field emission versus time.
Figure 7B:
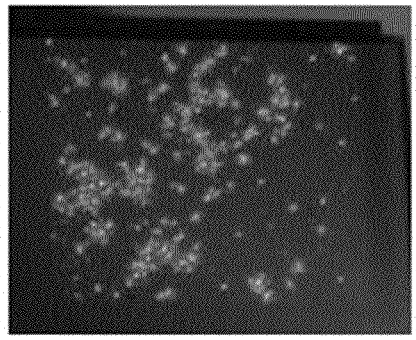
Figure 7C:
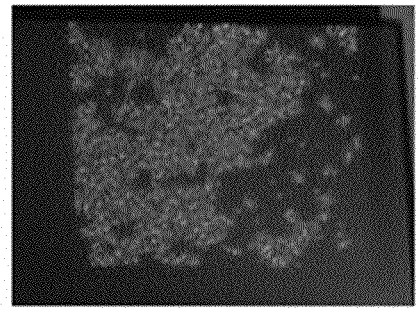
Figure 7D:
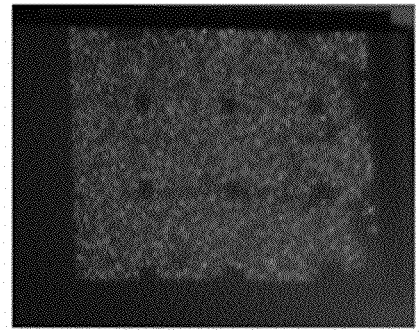

FIG. 6 shows field emission results according to the distance "a" between electrodes, and FIGS. 7A through 7D show abnormal field emission versus time. FIGS. 8A through 8D show field emission results according to the distance "b" between an electrode and a field emitter.

In particular, FIG. 6 shows results of a field emission experiment for a cathode A in which there was no insulated substrate between the field emitters (a=0) and cathodes B through D (a=150, 50, and 100 μm, respectively), in the state in which the distance "b" from the field emitter to the end of the cathode is fixed at 50 μm.

The four cathodes A through D shown in FIG. 6 are formed on the same glass substrate, and field emission results from application of voltage to the substrate. Compared to patterns A and C having the same field emitter area ratio (19.8%) for each block area (38.6×33 mm), patterns B and D have relatively smaller field emitter area ratios (13.8% and 16.2%, respectively) due to the greater distances between the electrodes. The results show that field emission of patterns B and D causes florescent materials to have greater brightness.

The field emission was induced by the same anode. However, more field emission resulted with patterns B and D having relatively greater distances between cathodes and smaller effective field emitter area ratios. This reason for this result is that as the distance "a" between the cathodes increases when the distance "b" from the field emitter to the end of the cathode is fixed, more charges accumulate on the cathode substrate, causing abnormal field emission. In other words, pattern A in which the distance "a" between the cathodes is 0, and pattern C in which the distance "a" between the cathodes is 50 μm, show similar light emission properties. In contrast, patterns B and D having distances "a" of 100 μm and 150 μm, respectively, cause the fluorescent materials to glow more brightly due to the abnormal field emission resulting from greater accumulation of charges on the insulated cathode substrate caused by the larger distances "a".

As shown in FIGS. 7A through 7D, the field emission property of pattern B shown in FIG. 6 versus time shows that the bright area increases with time. This is evidence that abnormal field emission results from charge accumulation on the substrate.

On the basis of the above experiment, it is required that the distance "a" between the cathodes be equal to or smaller than 50 μm for relatively stable field emission. Here, La is 50 μm.

This value may vary depending on the type and thickness of the cathode, or material properties, such as surface conductivity and the number of secondary electrons generated, of the cathode substrate.

Figure 8A:
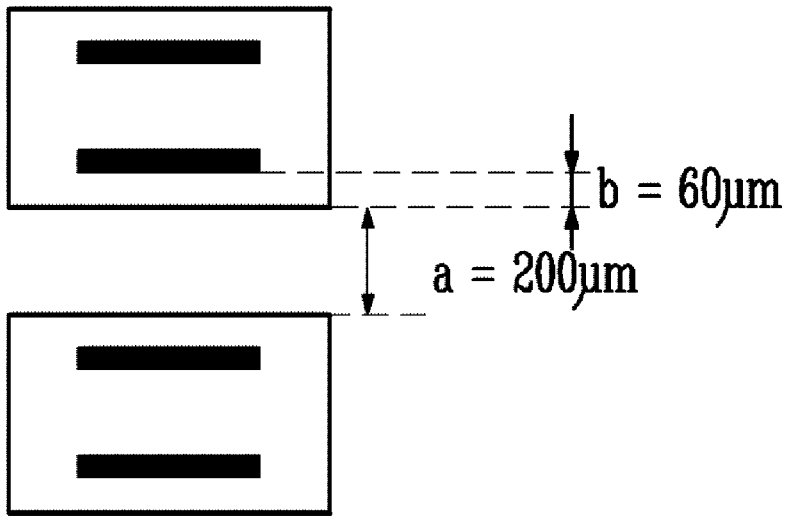
FIGS. 8A through 8D show field emission results according to distance "b" of FIG. 5.
Figure 8B:
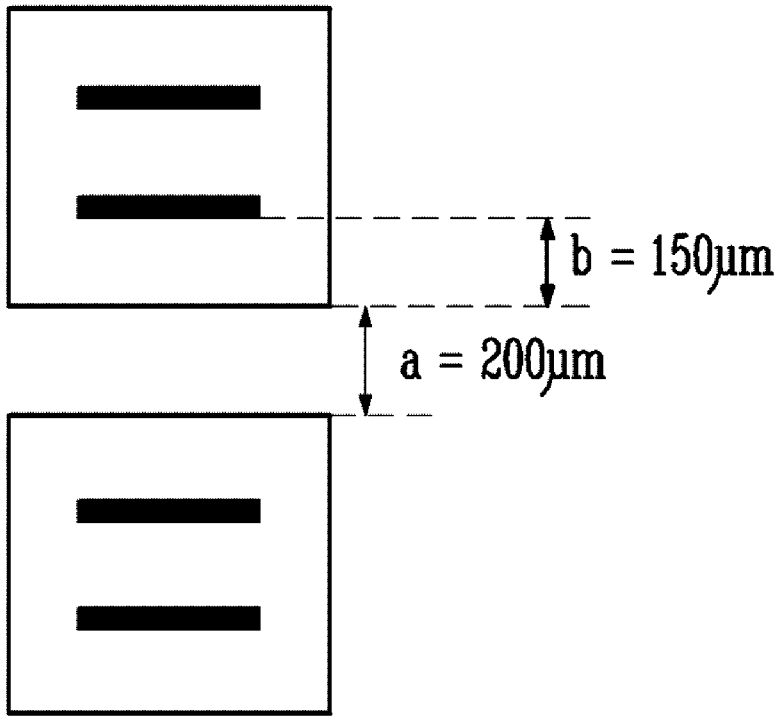

Next, FIGS. 8A and 8B show changes in field emission properties when the distance "a" between the cathodes is fixed at 50 μm and the distance "b" between the field emitter and the end of the cathode is varied.

Figure 8C:
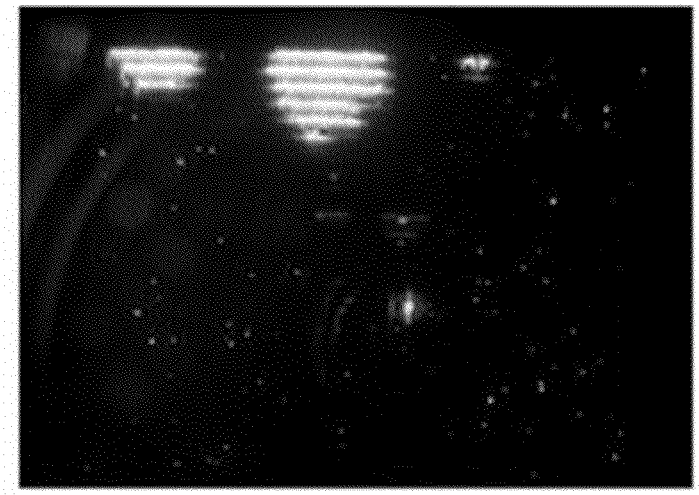

When the distance "b" is 60 μm as shown in FIG. 8A, a large amount of field emission occurs at only certain areas due to abnormal light emission resulting from charge accumulation as shown in FIG. 8C.

Figure 8D:
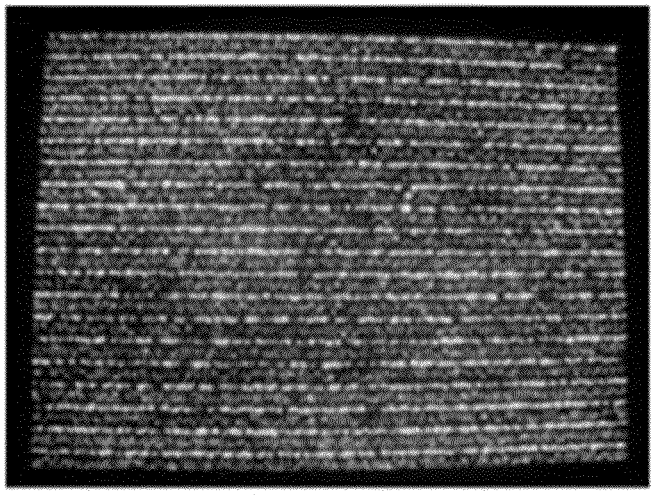

In contrast, when the distance "b" is increased to 150 μm as shown in FIG. 8B, field emission is stable as shown in FIG. 8D.

On the basis of the above experiment, it is required that the distance "b" between the cathodes be equal to or greater than 150 μm in order to relatively stably perform the field emission. Here, Lb is 150 μm.

This value may vary depending on the type and thickness of the cathode, or material properties, such as surface conductivity and the number of secondary electrons generated, of the cathode substrate.

As such, it is impossible to determine the distance "a" between the cathodes and the distance "b" between the field emitter and the end of the cathode arbitrarily. The distances "a" and "b" may be determined within certain ranges.

In consideration of the above experimental results, it is necessary that the distance "a" be equal to or smaller than 50 μm and the distance "b" be equal to or greater than 150 μm. The minimum value of the distance "a" may be the smallest value that can be achieved by semiconductor processing technology, and the maximum value of the distance "b" may be the largest value that does not lower the performance of the field emission device. In the above two experiments, a soda-lime glass substrate having a thickness of 1.1 mm may be used as the cathode substrate, and vacuum-deposited chrome electrodes having a thickness of 1500 Å may be used as the cathodes. Screen-printed CNT emitters having a height of about 2 to 3μm may be used as the field emitters.

Next, another exemplary embodiment of the present invention will be described with reference to FIGS. 9A through 10B.

Figure 9A:
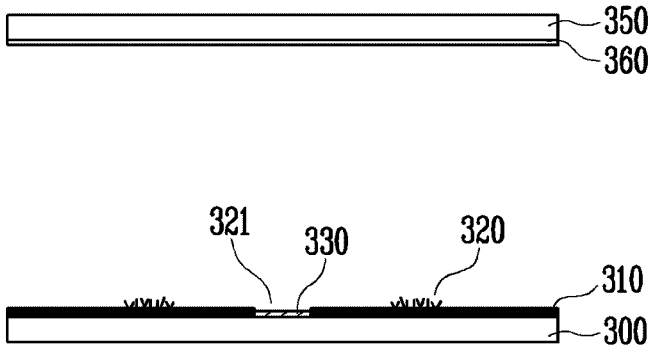
FIGS. 9A through 9C are cross-sectional views of a field emission device in accordance with another exemplary embodiment of the present invention.
Figure 9B:
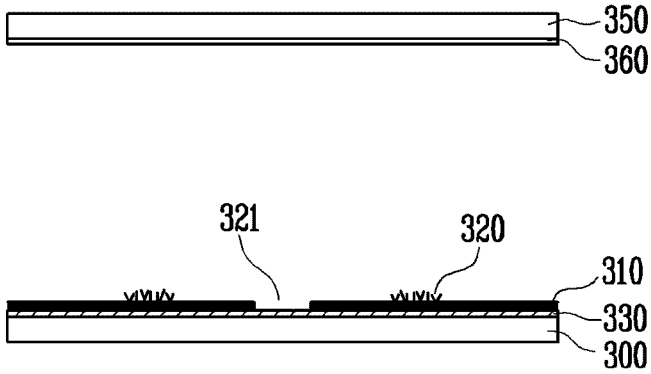
Figure 9C:
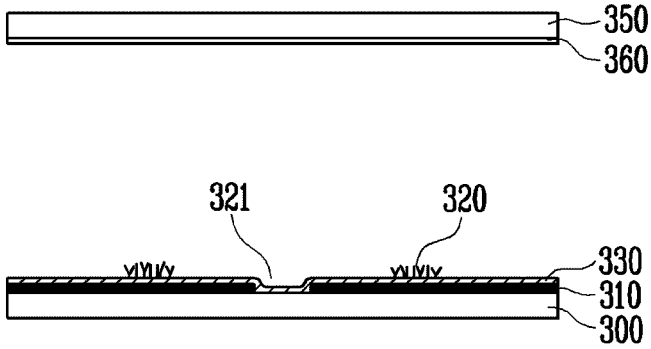

FIGS. 9A through 9C are cross-sectional views of a field emission device in accordance with another exemplary embodiment of the present invention.

As shown in FIGS. 9A through 9C, a plurality of cathodes 310 may be arranged to be separated from each other on a cathode substrate 300 facing an anode substrate 350 and an anode 360, and an field emitter 320 may be formed on each of the cathodes 310.

As shown in FIGS. 9A through 9C, a conductive resistor 330 may be formed between the cathodes 310 in order to prevent accumulation of charges on an exposed area of the cathode substrate 300 where no cathode is formed.

The conductive resistor 330 may be made of a material having a conductivity that can ignore leakage current between the cathodes 310 and is enough to dissipate accumulated charges. Accordingly, it is possible to prevent abnormal field emission and to stabilize field emission by dissipating the charges accumulated on the cathode substrate 300.

The conductive resistor 330 may be formed between the cathodes 310 as shown in FIG. 9A, or on the entire area between the cathode substrate 300 and the cathode 310 as shown in FIG. 9B. Alternatively, the conductive resistor 330 may be formed to cover an exposed area 321 of the cathode substrate 300 in which no cathode 310 is formed, after the cathodes 310 are formed.

Figure 10A:
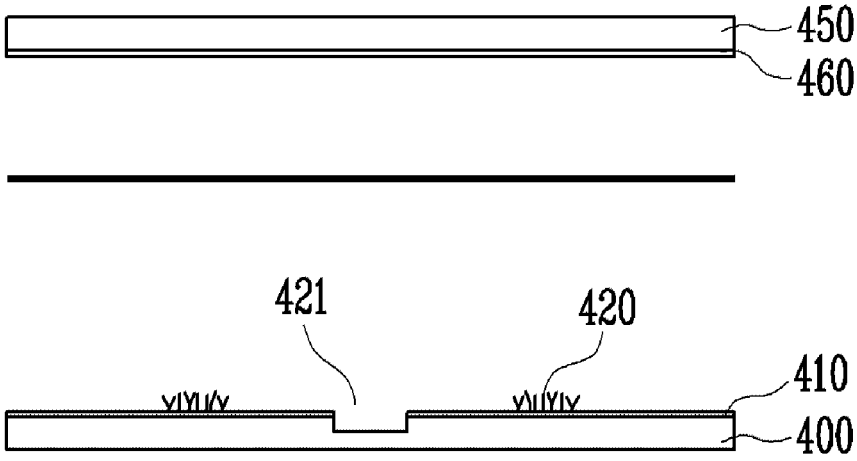
FIGS. 10A and 10B are cross-sectional views of a field emission device in accordance with yet another exemplary embodiment of the present invention.
Figure 10B:
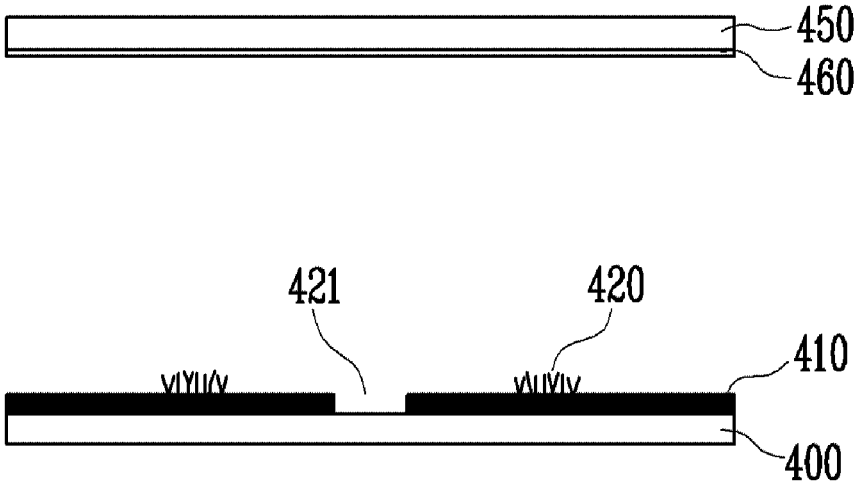

FIGS. 10A through 10B are cross-sectional views of a field emission device in accordance with yet another exemplary embodiment of the present invention.

As shown in FIGS. 10A and 10B, a plurality of cathodes 410 may be arranged to be separated from each other on a cathode substrate 400 facing an anode substrate 450 and an anode 460, and a field emitter 420 may be formed on each of the cathodes 410.

In the field emission device shown in FIG. 10A, a groove 421 may be formed on an exposed area of the cathode substrate 400 between the cathodes 410, in order to prevent electrons discharged from the field emitter 420 from hitting the field emission device and to minimize the effects of charge accumulation on the cathodes 410.

Here, the depth of the groove 421 may vary depending on the surface material, surface condition and electrical properties of the cathode substrate 400.

As shown in FIG. 10B, the groove 421 may also be formed between the cathode 410 and the cathode substrate 400 by increasing the thickness of the cathode 410 to obtain a similar effect to that of FIG. 10A. The cathode 410 may be formed by a thick-film forming method, such as a paste-printing method, instead of thin-film methods such as vacuum deposition or sputtering. The depth of the cathode 410 may vary depending on the surface material, surface condition, and electrical properties of the cathode substrate 400.

On the other hand, the field emission device in accordance with this exemplary embodiment of the present invention may employ a bi-electrode structure having a cathode and an anode, or a tri-electrode structure further having a gate electrode between the cathode and the anode.

Figure 11:
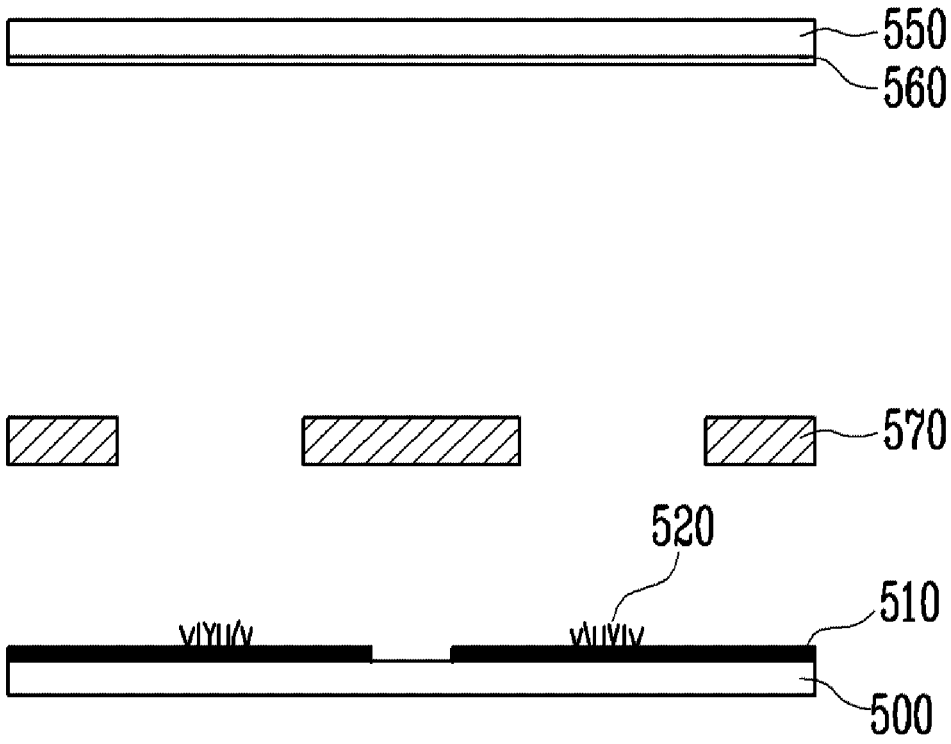
FIG. 11 is a cross-sectional view of a field emission device having a tri-electrode structure in accordance with the present invention.

FIG. 11 is a cross-sectional view of a field emission device having a tri-electrode structure.

As shown in FIG. 11, in the field emission device having a tri-electrode structure, a plurality of cathodes 510 may be arranged to be separated from each other on a cathode substrate 500 facing an anode substrate 550 and an anode 560, and a field emitter 520 may be formed on each of the cathodes 510. A gate electrode 570 may be further included in the field emission device having a tri-electrode structure. The gate electrode 570 may be placed between the anode 560 and the cathode 510.

The gate electrode 570 may also be formed with holes positioned over the field emitter 520 in order to ensure proper trajectories of electrons discharged from the field emitter 520

In the case of a bi-electrode structure having the anode 560 and the cathode 510, the anode 560 can generally not only supply an electric field that is equal to or greater than a threshold value to enable the field emitter 520 to discharge electrons, but can also accelerate the discharged electrons into the fluorescent material to thereby emit light.

Here, if the anode voltage is increased to obtain a sufficient light emission effect, an excessively strong electric field will be supplied to the field emitter 520, causing excessive field emission and arc discharge. This may damage the fluorescent material or the field emitter 520. Accordingly, it becomes difficult to stably manufacture the field emission device.

However, in the case of additionally placing the gate electrode 570, the gate electrode 570 can supply an electric field that is strong enough to enable the field emitter 520 to perform field emission, and the discharged electrons can pass through the gate holes and be accelerated by the anode 560. Accordingly, it is possible to distinguish the function of enabling field emission from the function of accelerating the electrons.

In this case, the field emission may be adequately performed by increasing the anode voltage and adjusting the gate voltage. Moreover, it is possible to protect the field emitter 520 from arc discharge generated by the high voltage of the anode 560 through the gate electrode 570.

Even in the tri-electrode structure, there may be unnecessary charge accumulation or arc discharge, similar to the aforementioned bi-electrode structure. In this case as well, the above solutions may be used.

Accordingly, it is possible to apply the range determination of the distances "a" and "b", the method of forming conductive material between the electrodes, and the method of forming a groove, to the field emission device having the tri-electrode structure, in which the gate electrode is further formed.

In a field emission device according to the present invention, since a plurality of cathodes are separated from each other on the same plane, it is possible to prevent abnormal field emission and arc generation due to accumulated charges between the cathodes, thereby performing stable operation.

While exemplary embodiments of the present invention have been described in detail, they are by no means intended to restrict the scope of the present invention. Those of ordinary skill in the art will understand that various modifications to the described exemplary embodiments and other exemplary embodiments are possible. The full scope of the present invention is defined by the appended claims.

What is claimed is:

1. A field emission device comprising:

an insulated cathode substrate facing an anode substrate;

a plurality of cathodes arranged on the cathode substrate and separated from each other; and an emitter formed on each of the cathodes, wherein a first distance between the plurality of cathodes is equal to or smaller than 50 μm.

2. The field emission device of claim 1, wherein a second distance from the emitter to corresponding ends of the plurality of cathodes is equal to or greater than 150 μm.

3. The field emission device of claim 2, wherein the cathode substrate is a soda-lime glass substrate.

4. The field emission device of claim 3, wherein the cathode is made of vacuum-deposited chrome and the first distance is about 50 μm and the second distance is about 150 μm.

5. The field emission device of claim 2, further comprising a gate electrode formed between the cathode and an anode to enable the emitter to discharge electrons.

6. A field emission device comprising:

an insulated cathode substrate facing an anode substrate;

a plurality of cathodes arranged on the cathode substrate and separated from each other; and an emitter formed on each of the cathodes;

wherein a first distance between the plurality of cathodes is equal to or smaller than 50 μm; and wherein a second distance from the emitter to corresponding ends of the plurality of cathodes is equal to or greater than 150 μm.

* * * * *